US005432688A

United States Patent [19]

Tobias et al.

[11] Patent Number: 5,432,688

[45] Date of Patent: Jul. 11, 1995

[54] PLASTIC NICHE AND GROUNDING ASSEMBLY THEREFOR

[75] Inventors: Samuel Tobias, Warren; Donald R. Davidson, Chatham; Robert H. Hanes, Rochelle Park, all of N.J.

[73] Assignee: H-Tech, Inc., Wilmington, Del.

[21] Appl. No.: 30,661

[22] Filed: Mar. 12, 1993

[51] Int. Cl.[6] ..... F21V 31/00

[52] U.S. Cl. ..... 362/101; 362/267; 362/294; 362/373

[58] Field of Search ..... 362/101, 145, 147, 267, 362/373, 294, 310; 4/253; 119/245, 246

[56] References Cited

U.S. PATENT DOCUMENTS

| | | | |
|---|---|---|---|
| 1,792,398 | 2/1931 | Rothen | 362/267 |
| 3,456,103 | 7/1969 | Bond | 362/267 |
| 3,949,213 | 4/1976 | Paitchell . | |
| 3,962,675 | 6/1976 | Rowley et al. | 362/101 |
| 4,281,367 | 7/1981 | Moore et al. | 362/267 |
| 4,460,944 | 7/1984 | Gordbegli et al. . | |
| 4,574,337 | 3/1986 | Poppenheimer | 362/267 |
| 4,779,174 | 10/1988 | Staten et al. . | |
| 5,050,052 | 9/1991 | Wade | 362/101 |

FOREIGN PATENT DOCUMENTS

| | | |
|---|---|---|
| 3121577 | 12/1982 | Germany . |
| 2021749 | 12/1979 | United Kingdom . |

OTHER PUBLICATIONS

Advertising brochure relating to "Sunsaver" High Performance Lights by Purex Pool Products, dated Oct. 1992.

*Primary Examiner*—Ira S. Lazarus
*Assistant Examiner*—Thomas M. Sember
*Attorney, Agent, or Firm*—Ralph W. Selitto, Jr.

[57] ABSTRACT

A housing for an underwater lighting fixture includes a wet niche formed from plastic and provided with a grounding strap. The grounding strap is attached to the niche by a threaded lug which extends through the strap and an adjacent wall of the niche to permit an internal ground wire and an external ground wire to be connected to the strap. As a further grounding assurance, the lighting fixture may be grounded through the grounding strap, which mechanically and electrically attaches the lighting fixture to the niche.

20 Claims, 2 Drawing Sheets

PLASTIC NICHE AND GROUNDING ASSEMBLY THEREFOR

FIELD OF THE INVENTION

The present invention relates to underwater lighting installations for swimming pools, spas and the like, and, more particularly, to wall-mounted niches (i.e., housings) for accommodating a lighting fixture of such installations.

BACKGROUND OF THE INVENTION

There are two basic types of underwater lighting installations for swimming pools, spas and the like. One type employs a dry "niche" or housing mounted in the wall of the pool below the water line for the purpose of receiving a lighting fixture. The dry niche is watertight so that pool water is prevented from surrounding the lighting fixture. The other type employs a wet niche, which is also a wall-mounted housing adapted to receive a lighting fixture, but which allows pool water to flow between the niche and the fixture.

Because a dry niche is designed to keep the lighting fixture dry, it must have a watertight seal which inhibits ready access for replacing bulbs, etc. In addition, since the seal must be maintained so as to prevent water from contacting the lighting fixture, it is necessary to service the lighting fixture from the rear of the niche. As can be imagined, these attributes of dry niches complicate manufacture, assembly and maintenance.

Certain disadvantages of dry niches are eliminated with a wet niche. For instance, because the lighting fixture of the wet niche is surrounded by water, there is no need for a watertight frontal seal. As a result, wet niches can be serviced from the front, rather than from the back.

Given the substantial electrical power required for standard lighting fixtures and the increased risk of shock associated with an aqueous environment, wet niches have been made from metal to guarantee adequate grounding (see, for instance, U.S. Pat. Nos. 4,460,944 and 3,949,213). In the past, U.L. code regulations have required that: (i) wet niches be made of electric conducting material; (ii) the lighting fixture be grounded through the connecting cord, as well as through the niche; and (iii) each niche be grounded to all other niches in the pool and to a suitable ground, e.g., a water pipe.

While plastic niches are in use in Europe, they are not provided with grounding assurances adequate under U.L. standards. This is due, at least in part, to the fact that the safety regulations imposed in Europe are less stringent than those imposed in the United States pursuant to U.L. code regulations.

Direct current pool lights that run on batteries have also been proposed for use in the United States and Europe. For example, U.S. Pat. No. 4,779,174 discloses a pool light with a plastic housing, the light being powered by direct current generated by flashlight batteries, as opposed to alternating current. Since the light uses such a small amount of power, there is little risk of electric shock associated with water infiltration and therefore grounding assurances are not needed.

SUMMARY OF THE INVENTION

The problems and disadvantages associated with conventional wet niches for underwater lighting fixtures are overcome by a new and improved niche which is made from electric insulating material, such as plastic, and which is provided with a grounding assembly for grounding an associated lighting fixture. The grounding assembly is capable of being attached to a pair of ground wires independent of the lighting fixture, one ground wire being located internally of the niche and the other ground wire being located externally of the niche. The grounding assembly is also mechanically and electrically attached to the lighting fixture itself, thereby providing another (i.e., a third) grounding path.

Another improvement provided by the present invention involves an adjustable outlet for the internal ground wire. The outlet includes an opening delimited by a socket which extends outwardly from the niche. An elbow fitting is rotatably received within the socket, while a slip fitting is removably received within the elbow fitting. By rotating the elbow fitting, an installer can vary the orientation of the elbow fitting relative to the niche. Different size electrical conduits can be attached to the niche depending upon whether or not the slip fitting is employed.

BRIEF DESCRIPTION OF THE DRAWINGS

For a better understanding of the present invention, reference is made to the following detailed description of an exemplary embodiment of the invention, considered in conjunction with the accompanying drawings, in which.

DESCRIPTION OF THE EXEMPLARY EMBODIMENT

Figure 1:
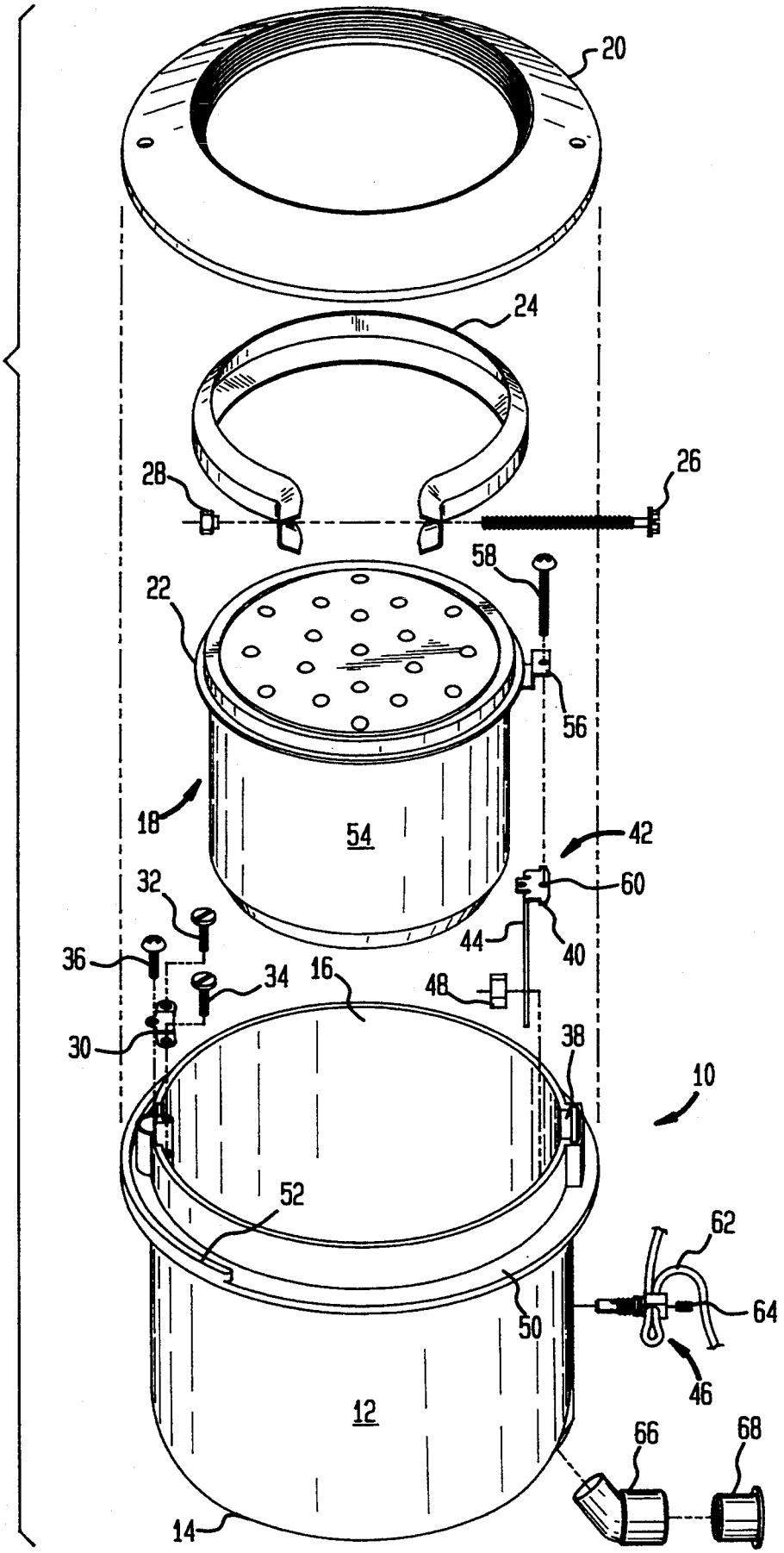
FIG. 1 is an exploded perspective view of a plastic niche and lighting fixture assembly constructed in accordance with an exemplary embodiment of the present invention.

FIG. 1 shows a niche 10 which includes a housing 12 preferably formed of plastic by injection molding or an equivalent process and having a closed end 14 and an open end 16. A lighting fixture 18 is received within the housing 12 through the open end 16 thereof. As shall be described in greater detail below, the lighting fixture 18 functions to provide underwater illumination for a pool in which it is installed. An escutcheon ring 20 is joined to an upper flanged end 22 of the lighting fixture 18 by a ring clamp 24 and an associated bolt 26 and a mating nut 28. Proximate the open end 16 of the housing 12, the niche 10 has a mounting plate 30 which is affixed by self-threading screws 32, 34 and which threadedly receives a fastener 36, such as a screw or bolt, for joining the escutcheon ring 20 to the niche 10 (see FIG. 2).

Diametrically opposite the mounting plate 30, the housing 12 has a recess 38 sized and shaped to receive a short leg 40 of an "L"-shaped grounding strap 42, which functions as a current collector. The grounding strap 42 also has a long leg 44, which includes a hole (not visible in FIG. 1) positioned so as to be in alignment with a corresponding hole (not visible in FIG. 1) provided in the side of the housing 12 when the short leg 40 of the grounding strap 42 is in place in the recess 38. A grounding lug 46 extends through the aligned holes in the housing 12 and the grounding strap 42 and threadedly receives a nut 48 disposed in the interior of the niche 10 for drawing the grounding lug 46 and the grounding strap 42 into snug mechanical and electrical contact to ensure a low-resistance, electrically-conductive pathway. The short leg 40 of the grounding strap 42 has a length of about ¾ of an inch and a width of about 1¼ inches, while the long leg 44 of the grounding strap 42 has a length of about 5 inches and a width of about 1¼ inches.

Because the niche 10 is designed for installation within the wall of an inground pool, the housing 12 has a flange 50 which be imbedded in the concrete or gunite of the pool wall, thereby anchoring the housing 12 in place. A retainer lip 52 projects from the flange 50 in order to promote the retainment of finishing plaster when the niche 10 is being installed in a horizontal position.

The lighting fixture 18 has an outer shell 54 which is made from metal and which has a mounting bracket 56 rigidly affixed thereto by, for instance, welding. The mounting bracket 56 receives a bolt 58, which is threaded into a bore 60 in the short leg 40 of the grounding strap 42 to thereby draw the mounting bracket 56 into an electrically conductive relationship with the grounding strap 42 and to also mechanically attach the lighting fixture 18 to the housing 12 of the niche 10.

The grounding lug 46 has a transverse hole (see FIG. 2) sized and shaped to receive a looped portion of a bonding wire 62. The looped portion of the bonding wire 62 is clamped in place by a set screw 64.

An elbow fitting 66 and a slip fitting 68 are employed to provide an adjustable conduit for electric feed and ground lines entering the niche 10. The elbow fitting 66 and the slip fitting 68 will be described in greater detail below.

Figure 2:
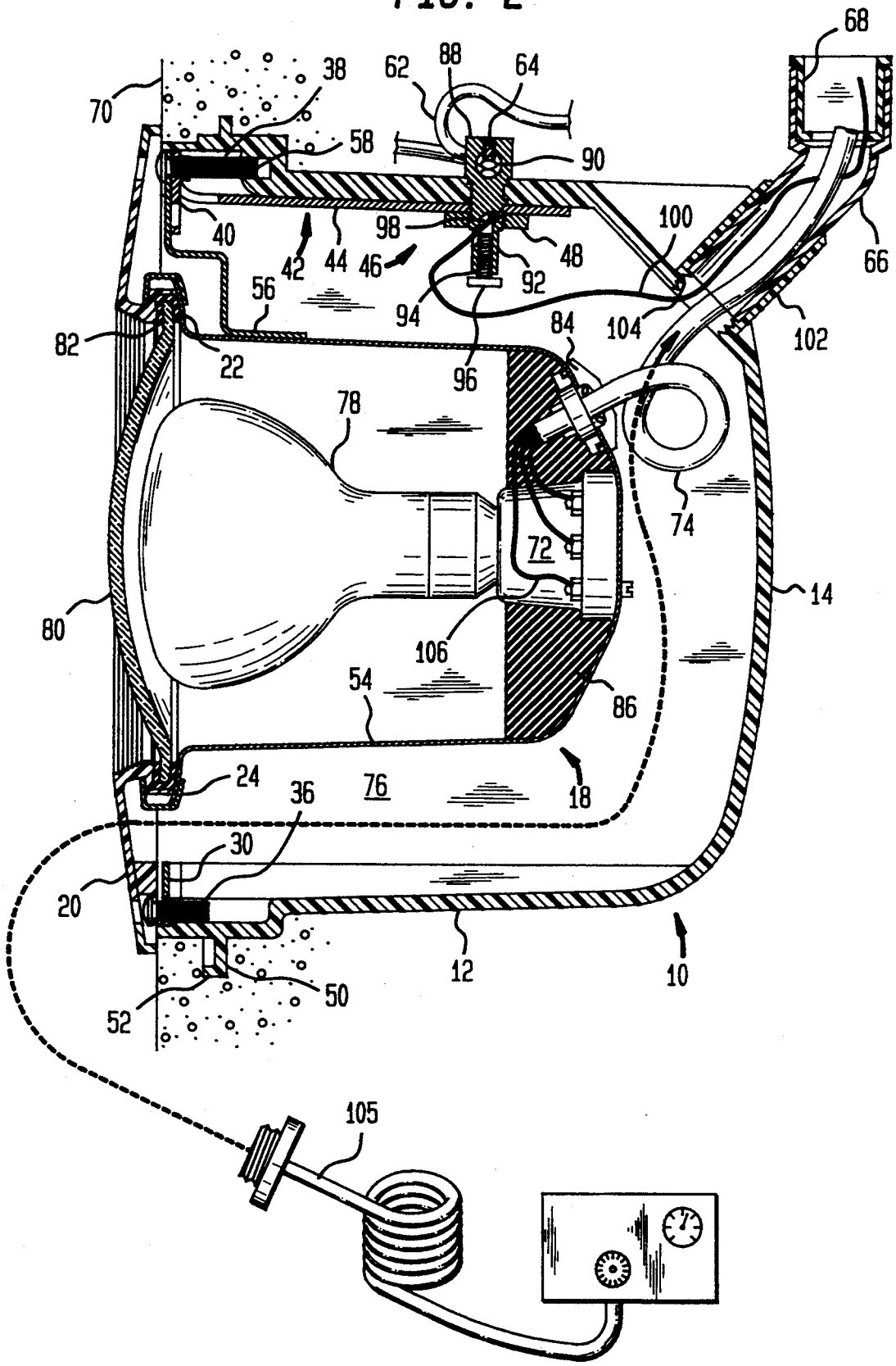
FIG. 2 is a cross-sectional view of the plastic niche and lighting fixture assembly of FIG. 1 installed in a pool wall.

FIG. 2 shows the niche 10 installed within a wall 70 of an inground pool. An incandescent light socket 72 is provided within the shell. 54 of the lighting fixture 18 and is held in place by welding, riveting, bolts or any other conventional means. A power cable 74, which supplies at least about 500 Watts of power, passes through the slip fitting 68 and the elbow fitting 66 and then into the housing 12 of the niche 10. A space 76 between the interior surface of the housing 12 and the shell 54 of the lighting fixture 18 accommodates water which serves to cool the lighting fixture 18 when it is heated by an incandescent bulb 78. Typically, the power cable 74 is coiled or wrapped around the shell 54 of the lighting fixture 18 to facilitate servicing.

As can be seen, the shell 54 of the lighting fixture 18 is sealed by virtue of a lens plate 80 and a gasket 82, which cooperate to prevent water from entering the shell 54. In addition, a cable seal 84 is provided to prevent water from entering the shell 54 at the point of entry of the power cable 74. For similar reasons, the socket 72 and connections to the power cable are potted with potting material 86.

A grounding arrangement in accordance the present invention is depicted in FIG. 2, wherein the short leg 40 of the grounding strap 42 is connected to the mounting bracket 56 by the bolt 58. The long leg 44 of the grounding strap 42 accommodates the grounding lug 46, which extends through the housing 12 and which is electrically and mechanically connected to the grounding strap 42 by the nut 48.

The grounding lug 46 is externally threaded so as to threadedly engage the nut 48 and has a faceted head 88 designed to facilitate tightening with a wrench. The head 88 of the grounding lug 46 has a transverse hole 90 sized and shaped to receive the bonding wire 62, which connects the niche 10 to adjacent niches and to an electrical ground. The diameter of the hole 90 is large enough so that the bonding wire 62 can be doubled over onto itself and still be inserted into the hole 90 where it is clamped in place by the set screw 64. The grounding lug 46 has a stem 92, which is provided with an axial bore 94 adapted to receive a set screw 96. An oblique bore 98 in the stem 92 receives a grounding wire 100, which is clamped in place by the set screw 96. An O-ring (not shown) may be used to effect a seal between the grounding lug 46 and the housing 12 of the niche 10. As can be appreciated, the bonding wire 62 and the grounding wire 100 cooperate to form a double grounding path.

A socket 102 is provided in the housing 12 for admitting the power cable 74 and the grounding wire 100. In the embodiment shown, the socket 102 is arranged at approximately a 45 degree angle relative to the longitudinal axis of the niche 10 and receives the elbow fitting 66, which can be bonded to the socket 102 by a suitable adhesive. The elbow fitting 66 can be rotated through 360 degrees prior to its attachment to the socket 102, whereby its outlet end is oriented in a manner which suits the needs of a particular installation. A threaded portion 104 of the socket 102 allows an installer to pressure test conduit connections before installing the power cable 74 by, for instance, attaching a sealing plug or a threaded air pressure line 105 to the housing 12 of the niche 10. The slip fitting 68, which can also be adhesively affixed to the elbow fitting 66, facilitates the connection of the niche 10 to electrical conduit by serving as an adapter for different conduit diameters. It should be understood that the elbow fitting 66 and the slip fitting 68 are optional elements and can be omitted, depending on installation requirements.

A third grounding assurance is typically provided in that the power cable 74 is a three wire cable and includes a grounding wire 106 which is attached to the shell 54 of the lighting fixture 18 internally. The grounding wire in the power cable 74 leads to a ground associated with the source of electricity, such as a grounded, three-prong outlet.

It should be understood that the embodiment described herein is merely exemplary and that a person skilled in the art may make many variations and modifications without departing from the spirit and scope of the invention as defined in the appended claims. For example, whereas a generally cylindrical niche for use in an inground pool is disclosed herein, the niche can be of any shape which adequately accommodates a corresponding lighting fixture and may be adaptable using well known techniques and designs to an above ground pool. Moreover, while a metal lighting fixture shell is shown, a plastic shell with comparable grounding assurances could be employed with the niche of the present invention. Thus, all such variations and modifications are intended to be included within the scope of the invention as defined in the appended claims.

We claim:

1. In a wet underwater lighting niche for housing an electric-powered lighting fixture with a cup-like metal shell in a wall of a swimming pool, spa or the like, the improvement wherein said niche is made from an electric insulating material and wherein said niche includes grounding means defining a plurality of alternative conductive pathways for conditionally grounding said lighting fixture in the event of a short, said grounding means including a first grounding pathway located substantially within said niche, a second grounding pathway located substantially within said niche, and a third grounding pathway located substantially within said niche; a metal strap current collector positioned proximate to an exterior surface of said lighting fixture shell, first connecting means mounted on said current collector for electrically connecting a first ground wire to said first grounding pathway at a first location internal of said niche such that said current collector is in said first grounding pathway, said first ground wire running from said first location to a second location external of said niche; second connecting means mounted on said current collector for electrically connecting a second ground wire to said second grounding pathway at a third location external of said niche such that said current collector is in said second grounding pathway, said second ground wire running from said third location to a fourth location external of said niche; third connecting means mounted on said lighting fixture shell for electrically connecting a third ground wire to said third grounding pathway at a fifth location internal of said niche, said third ground wire running from said fifth location to a sixth location external of said niche; and fourth connecting means for electrically connecting said current collector to said lighting fixture shell such that said current collector is in electrical continuity with said third grounding pathway, said current collector functioning as a junction for connecting said first, second and third grounding pathways to compensate for discontinuities arising in one of said pathways by conducting current to ground via another of said pathways and to accept electrical charge conducted through an aqueous solution wetting said current collector in the event of an electrical discontinuity between said lighting fixture shell and said current collector.

2. The improved niche of claim 1, wherein said plurality of alternative conductive pathways are insulated to prevent a user of said pool from contacting said conductive pathways.

3. The improved niche of claim 2, wherein said plurality of alternative conductive pathways are insulated from said user by a plastic escutcheon framing said niche.

4. The improved niche of claim 3, wherein said metal strap current collector has a width greater than ½ inch and a length greater than 3 inches.

5. The improved niche of claim 4, wherein said electric insulating material is plastic.

6. The improved niche of claim 5, wherein said metal strap current collector also functions as a mounting bracket to retain said lighting fixture in said niche.

7. The improved niche of claim 6, wherein said grounding means further includes a lug extending through said niche and said strap such that one end of said lug is located internally of said niche and an opposite end of said lug is located externally of said niche.

8. The improved niche of claim 7, wherein said lug includes an externally-threaded portion intermediate said ends thereof, said externally-threaded portion having external threads which cooperate with mating internal threads of an internally-threaded nut to mechanically and electrically connect said lug to said strap and to affix said strap to said niche.

9. The improved niche of claim 8, wherein said first connecting means includes first receiving means in said one end of said lug for receiving said first ground wire and said second connecting means includes second receiving means in said opposite end of said lug for receiving said second ground wire.

10. The improved niche of claim 9, wherein said first connecting means includes first clamping means for releasably clamping said first ground wire in said first receiving means of said lug and wherein said second connecting means includes second clamping means for releasably clamping said second ground wire in said second receiving means of said lug.

11. The improved niche of claim 10, wherein said first clamping means includes third receiving means communicating with said first receiving means and removably receiving a first clamp member and wherein said second clamping means includes fourth receiving means communicating with said second receiving means and removably receiving a second clamp member.

12. The improved niche of claim 11, wherein said first receiving means is a first bore, said second receiving means is a second bore, said third receiving means is a third bore, and said fourth receiving means is a fourth bore, said third and fourth bores being internally threaded.

13. The improved niche of claim 12, wherein said first clamp member is a first set screw in threaded engagement with said third bore and wherein said second clamp member is a second set screw in threaded engagement with said fourth bore.

14. The improved niche of claim 13, wherein said first bore extends obliquely into said lug and wherein said second bore extends transversely through said lug.

15. The improved niche of claim 2, wherein said first ground wire extends through an opening in said niche, said opening being provided in a socket extending outwardly from said niche.

16. The improved niche of claim 15, further comprising an elbow fitting having a first end received within said socket and a second end extending outwardly from said socket, said first end of said elbow fitting being rotatable relative to said socket, whereby the orientation of said second end of said elbow fitting relative to said niche can be varied.

17. The improved niche of claim 16, further comprising a slip fitting removably received in said second end of said elbow fitting.

18. The improved niche of claim 17, wherein said second end of said elbow fitting has a first diameter selected so as to be compatible with one size electrical conduit and wherein said slip fitting has a second diameter, selected so as to be compatible with another size electrical conduit.

19. The improved niche of claim 15, wherein said socket includes connecting means for releasably connecting said niche to a pressure-testing appliance.

20. The improved niche of claim 1, wherein said niche has an outwardly extending peripheral flange sized and shaped so as to anchor said niche in a concrete wall, said flange including an annular lip disposed on a lower portion of said peripheral flange projecting at about 90 degrees relative thereto and towards said swimming pool to retain wet plaster during installation of said niche.

* * * * *